5/27/86 XR 4,590,652

United States Patent [19]

Harwood

[11] Patent Number: 4,590,652

[45] Date of Patent: May 27, 1986

[54] METHOD FOR FABRICATING AN AIR GAP PIPE

[75] Inventor: Jon W. Harwood, Toledo, Ohio

[73] Assignee: APX Group Inc., Toledo, Ohio

[21] Appl. No.: 671,416

[22] Filed: Nov. 14, 1984

Related U.S. Application Data

[62] Division of Ser. No. 541,709, Oct. 14, 1983, Pat. No. 4,501,302.

[51] Int. Cl.[4] ..... B21D 53/00; B23P 15/26; F16L 9/18

[52] U.S. Cl. ..... 29/157 R; 29/416; 29/455 R; 29/463; 29/DIG. 48; 60/322; 138/113; 138/114; 138/148; 181/283; 219/121 PC; 219/121 PH; 219/121 LG; 219/121 LM; 228/141.1; 228/170; 228/173.4

[58] Field of Search ..... 29/416, 455 R, 157 R, 29/157 A, 157 T, 237, 282, 412, 463, DIG. 13, DIG. 48; 60/320, 321, 322; 181/282, 283; 138/111, 113, 114, 148, 178; 219/121 EH, 121 EK, 121 EM, 121 LG, 121 LM, 121 LN, 121 PC, 121 PH; 228/141.1, 170, 173.4

[56] References Cited

U.S. PATENT DOCUMENTS

| | | | |
|---|---|---|---|
| 236,077 | 12/1880 | Peirce | 138/114 X |
| 1,618,611 | 2/1927 | Trout | 29/455 R |
| 2,274,519 | 2/1942 | Barrett | 29/455 R X |
| 2,329,938 | 9/1943 | Ortiz | 228/170 |
| 2,370,062 | 3/1941 | Mercier | 60/320 |
| 2,959,196 | 11/1960 | Truesdell et al. | 138/148 X |
| 3,009,484 | 11/1961 | Dollens | 181/282 X |
| 3,104,732 | 9/1963 | Ludlow et al. | 29/157 R |
| 3,209,856 | 10/1965 | Saunders | 138/148 X |
| 3,219,142 | 11/1965 | Deremer | 29/157 R |
| 3,457,724 | 6/1967 | Gandy et al. | 60/320 X |
| 3,645,092 | 2/1972 | Tatsutomi et al. | 60/322 |
| 3,884,194 | 5/1975 | Grosseau | 60/320 X |
| 3,908,372 | 9/1975 | Fowler et al. | 60/320 |
| 4,031,699 | 6/1977 | Suga et al. | 60/322 X |
| 4,185,463 | 1/1980 | Tanahashi et al. | 60/322 |

FOREIGN PATENT DOCUMENTS

| | | | |
|---|---|---|---|
| 2642995 | 3/1978 | Fed. Rep. of Germany | 60/320 |
| 193289 | 11/1982 | Japan | 219/121 LG |
| 632013 | 11/1949 | United Kingdom | 181/282 |

*Primary Examiner*—Mark Rosenbaum
*Assistant Examiner*—Ronald S. Wallace
*Attorney, Agent, or Firm*—Anthony J. Casella; Gerald E. Hespos

[57] ABSTRACT

An air gap pipe and a method for forming the same are provided. The air gap pipe includes a non-linear outer pipe and an inner pipe of identical configuration disposed concentrically within the outer pipe. The inner pipe is supported by resilient dimples in the outer pipe. The outer pipe is placed in a condition for receiving the inner pipe by longitudinally cutting the outer pipe in half with a pre-programmed plasma arc or laser cutting apparatus. The two halves of the outer pipe are secured together to provide vents, if necessary, for selective dissipation of heat.

4 Claims, 8 Drawing Figures

METHOD FOR FABRICATING AN AIR GAP PIPE

This application is a division of application Ser. No. 541,709 filed on Oct. 14, 1983, now U.S. Pat. No. 4,501,302 issued Feb. 26, 1985.

BACKGROUND OF THE INVENTION

Exhaust gases generated by combustion in a vehicular engine are directed from the engine through a series of pipes, one or more mufflers, and certain emission control equipment prior to being released into the atmosphere at a safe location on the vehicle. In traveling from the engine to the point where the exhaust is released into the air, the pipes must be circuitously directed around or through other essential components of the vehicle, such as the engine itself, the drive train, the passenger compartment, tanks for fuel or coolant, axles and various structural supports.

The exhaust gases generally are at an elevated temperature and cause the pipes through which they pass to be heated. Frequently it is necessary to physically separate and insulate these heated pipes from other parts of the vehicle or from ambient surroundings. In other instances it may be desirable to pass the exhaust in a heat exchange relationship with cooler air in order to either lower the temperature of the exhaust or to provide heated air for other uses in the vehicle.

In the past the exhaust pipes occasionally have been separated from other parts of the vehicle by heat shields. Heat shields typically have been linear members which are bolted into position intermediate the exhaust pipe and the part of the vehicle to be separated from the heated exhaust. In most instances a gap exists between the exhaust pipe and the heat shield and a second gap exist between the heat shield and the remainder of the vehicle. Two or more opposed heat shields occasionally are used when the exhaust pipe is directed in between two portions of the vehicle which must be separated from the heat.

In certain vehicles it has been found necessary to wind the exhaust pipe circuitously between several vehicular components all of which must be protected from the heat. Space limitations often preclude heat shields in these situations. As a result, in these instances, it has been necessary to employ two generally concentric pipes which extend along the circuitous path through the vehicle. More particularly the inner of the two concentric pipes carries the exhaust from the engine, while the outer pipe separates the heated inner exhaust pipe from the adjacent areas of the vehicle. This structural configuration also enables the air gap between the pipes to perform an insulating function.

Air gap exhaust pipes have been difficult and costly to manufacture. Typically a straight inner pipe with support legs welded to its outer surface is mounted within a straight outer pipe. The support legs maintain the inner and outer pipes in concentric relationship. In certain instances the two straight pipes are concentrically arranged with respect to one another, and dents are formed in the outer pipe to support the inner pipe. To enable concentric bending of the two pipes, a filler then is inserted into the air gap. The filler may either be a granular material, such as sand, or an alloy with a low melting point. With the filler in place, the two pipes then are bent into the desired, circuitous configuration, while still maintaining their concentricity. After the pipes have been bent, the filler is either flushed or melted out.

The above described air gap pipe is expensive and slow to manufacture primarily because of the costs and time required to properly insert and remove the filler. Additionally, to the extent that support legs are used, they tend to perform poorly under conditions of differential thermal expansion and contraction. Specifically if support legs are welded to the inner pipe to provide a secure fit when the pipes are cool, the legs may damage the inner or outer pipe when heat is applied. If the support is provided by dents in the outer pipe, the force exerted to create the dents often will dent both pipes, to either damage the inner pipe or result in a non-concentric alignment.

Attempts have been made to bend the inner and outer pipes separately, and then to utilize a band saw to cut the outer pipe in half along its length. The two halves then were separated and legs were welded to the inner surfaces of the outer pipe halves. The outer pipe halves then were placed around the inner pipe and were welded along the two cut lines. This band saw cutting operation is extremely slow and only can be carried out manually on a piece by piece basis for pipes with simple bends. Consequently this process has been carried out only on very small orders where costs would normally be high in any event. The band saw cuts also tend to be quite rough and must be finished to remove burrs and discontinuous edges. The manual band saw cutting also creates inventory control problems since no two pipes are cut exactly the same. The air gap pipe also has suffered from the above described structural problems caused by expansion and contraction of the legs welded to the inner surface of the outer pipe.

In the past, high energy cutters such as plasma arc and laser cutters have been widely used to cut a variety of shapes into metal pieces. However, neither plasma arc nor laser cutters have been adapted to cut pipes along their longitudinal axis, particularly after the pipes have been bent into complex shapes.

In view of the above, it is an object of the subject invention to provide a method for producing an air gap pipe efficiently and inexpensively.

It is another object of the subject invention to provide a method for producing an air gap pipe in which the inner pipe is efficiently supported within the outer pipe under a broad range of operating temperatures.

It is a further object of the subject invention to provide a method for producing an air gap pipe which will not damage or deform the inner pipe.

It is an additional object of the subject invention to provide an air gap pipe with an improved ability to perform under a broad range of operating conditions.

It is still another object of the subject invention to provide an air gap pipe with an enhanced ability to dissipate heat.

SUMMARY OF THE INVENTION

The air gap pipe of the subject invention is formed from inner and outer pipes which are bent into substantially identical shapes prior to insertion of the inner pipe inside the outer pipe. Dimples are pressed inwardly into the outer pipe either before or after bending. More particularly the dimples are pressed inwardly a sufficient distance to enable the inner pipe to be supported centrally within the outer pipe on the dimples. Preferably the dimples are of a size and shape to perform resiliently under various conditions of temperature and shock.

After the outer pipe has been bent, and the dimples have been formed, the pipe is placed in a high energy cutter such as a plasma arc or laser cutting apparatus which is pre-programmed to cut the bent outer pipe longitudinally. More particularly, a plasma arc or laser cutter is incorporated into an apparatus which is adapted to move through a programmed array of x-y-z coordinates. Thus, the bent outer pipe is mounted on the apparatus which incorporates the plasma arc or laser cutter, and the specific shape of the bent outer pipe is programmed into the memory of the apparatus. The plasma arc or laser cutter then follows the programmed path to cut the outer pipe along its circuitous length.

After the outer pipe has been cut, as described above, the two elongated halves are removed from one another and are placed on opposed sides of the inner pipe bent to substantially the same configuration. In this position, the inner pipe is substantially concentrically mounted on the dimples in the outer pipe. The two outer pipes then are welded to one another along the line of the plasma arc cut. Preferably at least a portion of the welding of the two outer pipe halves is in the form of spot welding approximately every six to twelve inches along the length of the outer pipe. This welding pattern securely holds the two halves of the outer pipe together yet provides elongated vents along the length of the air gap pipe. The vents, it has been discovered, contribute to a more rapid dissipation of heat from the inner pipe. In certain situations, however, it is desirable to continuously weld one or both sides of the seam between the inner and outer pipes. For example, the weld should extend continuously along one seam of the outer pipe when it is desirable to dissipate the heat primarily in one direction. In other instances, it is desirable to direct the heat longitudinally along the length of the pipe, for subsequent heat exchange with air, fuel or water used in the vehicle.

As noted above the dimples are effective shock absorbers, and can more readily accommodate differential expansion than the previously described supports. Furthermore, since the dimples are pressed into outer pipe prior to placement of the inner pipe, the force used to create the dimples in the outer pipe does not damage or deform the inner pipe.

In addition to the time savings resulting from the above described plasma arc cutting or laser apparatus, it has been found that the plasma arc cutter provides a precisely trimmed first cut, thereby avoiding the machining required to remove rough edges of pipes cut by a band saw. It also has been found that the precision attainable with the above described plasma arc or laser cutting apparatus makes it possible to utilize the top half of one outer pipe with the bottom half of another outer pipe. Consequently, to accomodate certain day to day manufacturing demands, it is possible to cut a plurality of outer pipes to create an inventory of top and bottom outer pipe halves. Top and bottom outer pipe halves then may be selected randomly from the respective inventories without checking that the two halves originated from the same outer pipe. This often is an important consideration when the outer pipes must be transported from a cutting to a welding location in a manufacturing facility, or when a single team which assembles the air gap pipes is required to complete its cutting tasks rapidly in order to free up the plasma arc cutting apparatus for a series of cuts based upon a different programmed configuration.

DETAILED DESCRIPTION OF THE PREFERRED EMBODIMENT

Figure 1A:
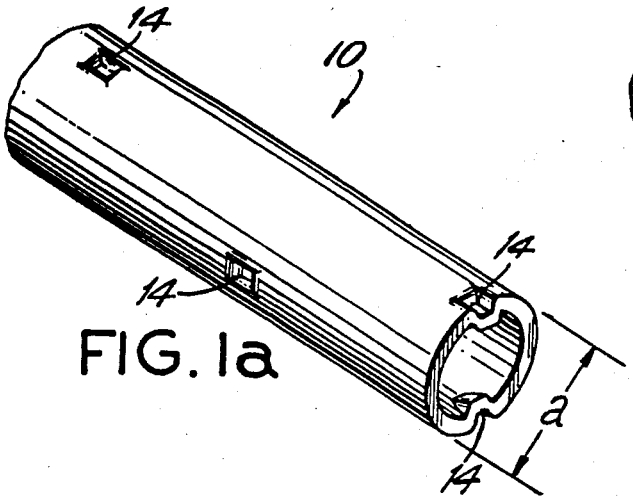
FIG. 1*a* is a perspective view of the outer pipe of the subject invention.
Figure 1B:
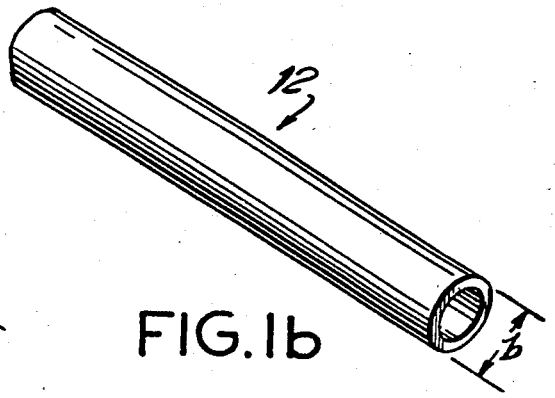
FIG. 1*b* is a perspective view of the inner pipe of the subject invention.

The outer pipe of the subject invention is indicated generally by the numeral 10 in FIG. 1*a*, while the inner pipe is indicated generally by the numeral 12 in FIG. 1*b*. The diameter "a" of the outer pipe 10 is larger than the diameter "b" of the inner pipe 12. More particularly, the respective diameters "a" and "b" of the outer and inner pipes 10 and 12 are selected to enable the inner pipe 12 to slide within the outer pipe 10 and to leave an annular air gap therebetween. As explained further below, the air gap between the outer and inner pipe 10 and 12 typically is between one-quarter and one-half inch.

The outer pipe 10, as shown in FIG. 1*a* includes a plurality of inwardly directed dimples 14. The dimples 14 may be machine pressed into the outer pipe 10, and the depth of each dimple 14 is substantially equal to the radial distance between the inner and outer pipes 10 and 12 on the air gap pipe assembled therefrom. The dimples 14 are of a size and configuration to ensure resiliency when subjected to outward radial forces as encountered during differential expansion of the pipes or shocks as the vehicle moves along a road.

Figure 2B:
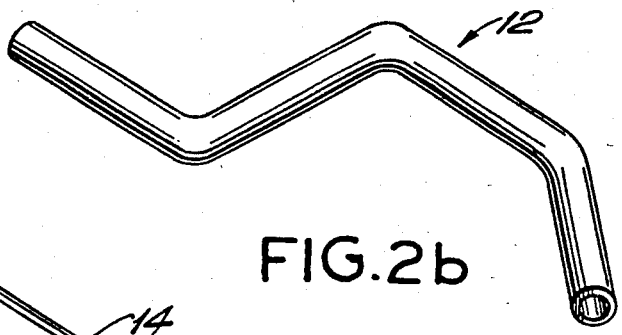
FIG. 2*b* is a second perspective view of the inner pipe of the subject invention.
Figure 2A:
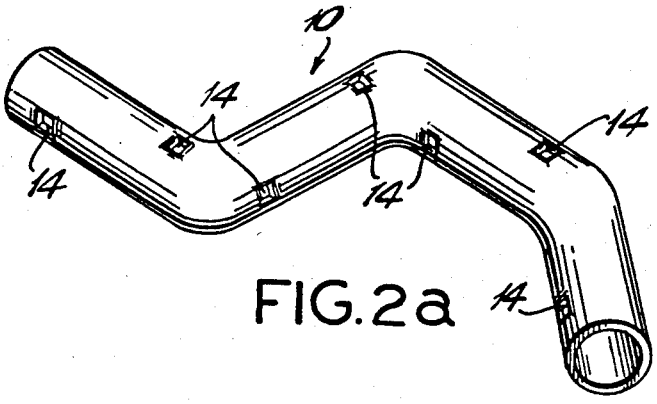
FIG. 2*a* is a second perspective view of the outer pipe of the subject invention.

As shown in FIGS. 2*a* and 2*b*, the outer and inner pipes 10 and 12 are bent into a particular shape as required by the design of the vehicle with which the subject pipes are to be used. The outer and inner pipes 10 and 12 are of substantially identical configuration to enable the inner pipe 12 to be placed concentrically within the outer pipe 10 as explained further below. The outer and inner pipes 10 and 12 can be bent into the required configuration by a manually operated apparatus, but according to the preferred method, the outer and inner pipes 10 and 12 are bent into the desired shape by a programmed bending apparatus. Several such bending apparatus are available which are programmed with specific x-y-z coordinates for bending the pipes through preselected angles. With the typical programmed bending apparatus, the pipes are individually mounted in the apparatus and each pipe then is moved sequentially through pre-programmed distances and angles with respect to a stationary bending head to precisely form the pipe into a desired shape. Although the outer pipe 10 is shown as having the dimples 14 formed prior to bending, it is possible to form the dimples after bending.

Figure 3:
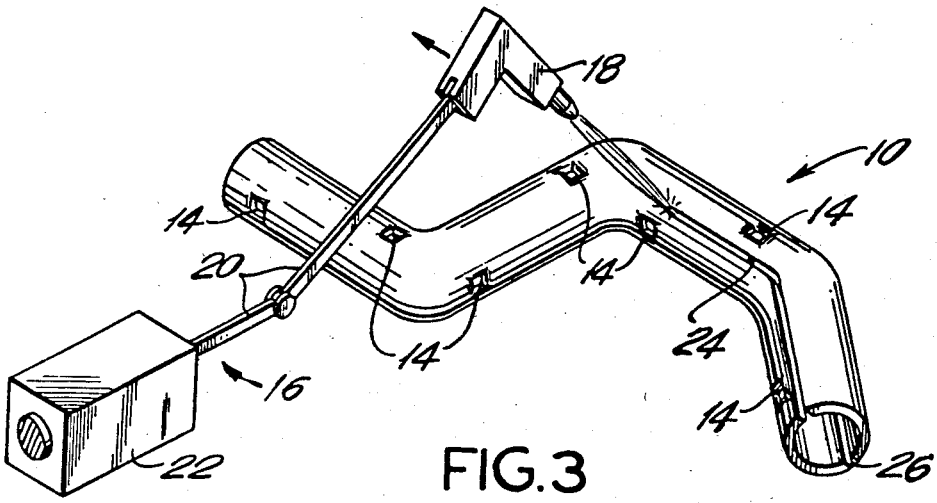
FIG. 3 schematically shows the plasma arc cutting apparatus cutting the outer pipe according to the subject invention.

After the outer and inner pipes 10 and 12 have been appropriately bent and after the dimples 14 have been placed in the outer pipe 10, the outer pipe 10 is mounted in the plasma arc cutting apparatus which is illustrated schematically and identified generally by the numeral 16 in FIG. 3. The plasma arc cutting apparatus 16 includes a cutting portion 18, mounting portions 20 and controller 22. The controller 22 is programmed with the specific x-y-z coordinates of the bent outer pipe 10. This programmed information causes the arms 20 to move the cutting portion 18 at a continuous speed along the outer pipe 10 to form longitudinal cut 24. A corresponding cut 26 can be formed simultaneously or as a separate and later step of the process on the opposite side of the outer pipe 10. Plasma arc cutting apparatus 16 is able to provide cuts 24 and 26 which are accurate, smooth edged, and more quickly completed than previously had been available with band saws and other such equipment.

Figure 4:
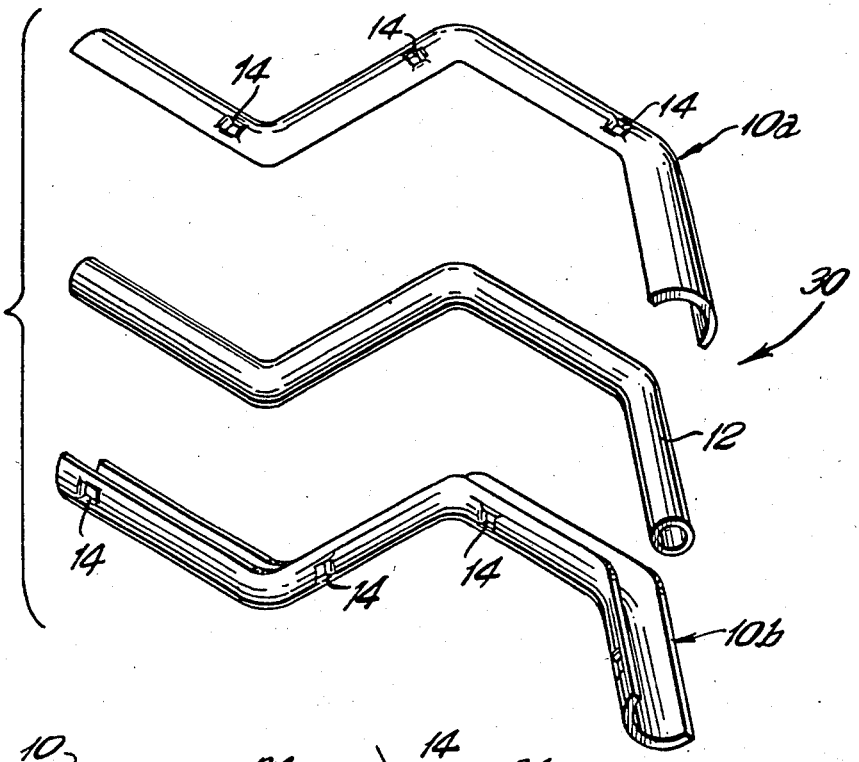
FIG. 4 is an exploded perspective view of the inner and outer pipes.
Figure 5:
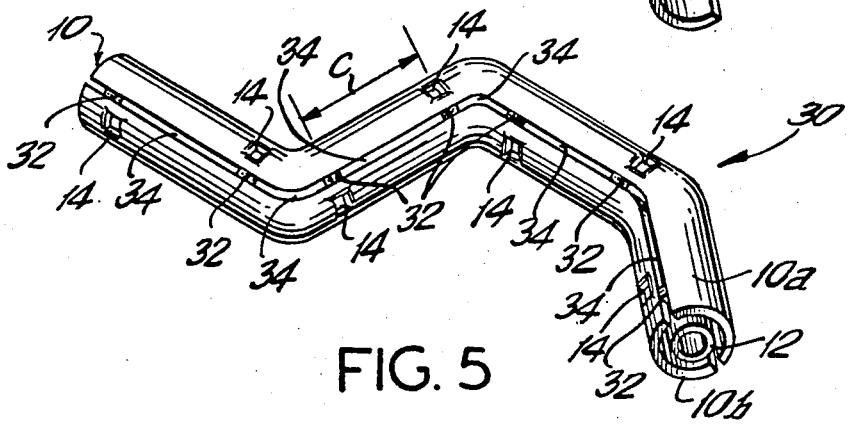
FIG. 5 is a perspective view of the assembled inner and outer pipes.
Figure 6:
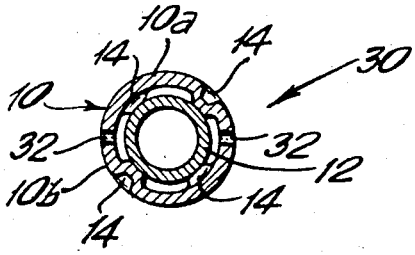
FIG. 6 is a cross-sectional view of the subject air gap pipe.

Turning to FIG. 4, the air gap pipe 30 is formed from first and second outer pipe halves 10*a* and 10*b* and inner pipe 12. Due to the accuracy of the above described plasma arc cutting apparatus 16, it is not essential that the first and second outer pipe halves 10*a* and 10*b* be derived from the same pipe. As illustrated in FIGS. 4 through 6, the first and second outer pipe halves are positioned to concentrically surround the inner pipe 12, with the inner pipe 12 supported on the dimples 14.

The outer pipe halves 10*a* and 10*b* are secured to one another after the inner pipe 12 has been positioned therebetween. Preferably, as shown in FIG. 5, the first and second halves 10*a* and 10*b* of the outer pipe 10 are joined together by a plurality of spot welds 32. The distance "c" between adjacent spot welds 32 is approximately 6 to 12 inches. Intermediate adjacent spot welds 32 are vents 34.

The above described construction with selectively located vents 34 enables certain parts of the vehicle to be adequately separated from the heated inner pipe 12, but also enables controlled and rapid dissipation of heat. For example one entire cut 24 or 26 may be continuously welded to prevent rapid dissipation of heat in that direction, while the opposed cut 24 or 25 may be spot welded to encourage a uni-directional dissipation of heat. Alternatively, it may be desirable to completely weld both cuts 24 and 26 along a selected portion of the air gap pipe 30 to dissipate heat along other sections of the air gap pipe 30. In instances where it is desirable to direct the heated air along the entire length of the air gap pipe 30, the welds along cuts 24 and 26 may be continuous.

As shown most clearly in FIG. 6, the inner pipe 12 is centrally supported by dimples 14. Since the dimples 14 are formed prior to welding, the desired pre-load condition is attained without deforming the inner pipe 12. Each dimple 14 preferably is defined by generally arcuate inwardly directed deformations in the outer pipe 10. As a result of this construction each dimple 14 exhibits a resiliency which enables the dimples 14 to respond to thermal expansion and contraction of the inner pipe 12. The size and shape of each dimple 14 is selected to provide the desired resiliency for the range of temperature and shock conditions that are anticipated. Thus, as the inner pipe 12 heats and expands, the individual dimples 14 will resiliently absorb this expansion. When the inner pipe 12 later cools and contracts, the dimples 14 will resiliently return to their previous position. These resilient characteristics also provide better support in the high vibration environments to which most vehicles are subjected.

In summary an improved air gap pipe and a method for forming the same are provided. The air gap pipe is formed from inner and outer pipes which are dimensioned to enable the inner pipe to fit concentrically within the outer pipe with an annular space therebetween. The outer pipe is formed with a plurality of supporting dimples each of which has a depth substantially equal to the radial thickness of the annular space between the inner and outer pipes. The dimples are formed to provide a resilient support for the inner pipe under a range of temperature and vibration conditions. The inner and outer pipes are bent into identical configurations which conform to the design of a particular vehicle. The outer pipe then is longitudinally cut by a pre-programmed plasma arc cutting apparatus. The longitudinal cut enables the outer pipe to be separated into first and second halves. The inner pipe then is disposed centrally between the halves of the outer pipe and supported by the dimples. Once in this position, the two halves of the outer pipe are welded together. Spot welds are selectively disposed intermediate the first and second halves of the outer pipe to enable controlled dissipation of heat.

While the invention has been described with respect to a preferred embodiment, it is understood that various modifications may be made without departing from the spirit of the subject invention as defined by the appended claims.

What is claimed is:

1. A method for forming a non-linear air gap pipe for use with an engine exhaust system, said air gap pipe comprising inner and outer pipes dimensioned to enable the inner pipe to be supported within the outer pipe with an air gap therebetween, said method comprising the steps of:

forming inwardly extending resilient dimples in the outer pipe extending inwardly a distance sufficient to support the inner pipe therein;

bending the inner and outer pipes into substantially identical non-linear configurations for use in the exhaust system;

providing a cutting apparatus selected from the group consisting of laser cutting apparatus and plasma are cutting apparatus, said cutting apparatus being movable and programmable to follow the nonlinear configuration of the bent outer pipe;

securely mounting the bent outer pipe in proximity to the cutting apparatus;

moving the cutting apparatus relative to the outer pipe to cut the outer pipe longitudinally in half to define first and second outer pipe halves;

supporting the inner pipe on the dimples of the outer pipe and intermediate the first and second outer pipe halves; and welding the outer pipes halves together at selected locations to define an air gap pipe and to control the flow of heat from the air gap pipe.

2. A method as in claim 1 wherein the outer pipe halves are welded at spaced apart locations along the opposed longitudinal sides thereof.

3. A method as in claim 1 wherein the welding comprises a substantially continuous weld extending along at least one longitudinal side of said outer pipe.

4. A method as in claim 3 wherein the welding extends substantially continuously along both longitudinal sides of said outer pipe.

* * * * *